US009897033B2

(12) United States Patent
Peters et al.

(10) Patent No.: US 9,897,033 B2
(45) Date of Patent: Feb. 20, 2018

(54) HIGH PRESSURE, HIGH SPEED REGULATING SWITCH VALVE

(71) Applicant: Cummins Inc., Columbus, IN (US)

(72) Inventors: Lester L. Peters, Columbus, IN (US); David L. Buchanan, Westport, IN (US); Bradlee J. Stroia, Columbus, IN (US); William David Daniel, Scipio, IN (US); Rajesh K. Garg, Columbus, IN (US); Richard D. Thomas, North Vernon, IN (US)

(73) Assignee: CUMMINS INC., Columbus, IN (US)

( * ) Notice: Subject to any disclaimer, the term of this patent is extended or adjusted under 35 U.S.C. 154(b) by 196 days.

(21) Appl. No.: 14/713,489

(22) Filed: May 15, 2015

(65) Prior Publication Data

US 2015/0330344 A1 Nov. 19, 2015

Related U.S. Application Data

(60) Provisional application No. 61/993,412, filed on May 15, 2014.

(51) Int. Cl.

| | |
|---|---|
| ***F02M 51/06*** | (2006.01) |
| ***F02D 41/38*** | (2006.01) |
| ***F02M 61/18*** | (2006.01) |
| ***F02M 61/06*** | (2006.01) |

(52) U.S. Cl.

CPC ..... *F02D 41/38* (2013.01); *F02M 51/06* (2013.01); *F02M 61/06* (2013.01); *F02M 61/1886* (2013.01); *F02M 61/1893* (2013.01); *F02D 2041/389* (2013.01); *F02D 2250/31* (2013.01)

(58) Field of Classification Search

CPC ..... F02D 41/38; F02D 2041/389; F02D 2250/31; F02M 51/06; F02M 61/06; F02M 61/1886; F02M 61/1893; F02M 47/027; F02M 63/0026; F02M 63/0045; F02M 63/0007; F02M 45/12; Y10T 137/86879; Y10T 137/85815

USPC ..... 239/96, 533.2; 137/625.4, 625.48

See application file for complete search history.

(56) References Cited

U.S. PATENT DOCUMENTS

| | | | | |
|---|---|---|---|---|
| 5,651,345 | A | 7/1997 | Miller et al. | |
| 6,036,120 | A * | 3/2000 | Varble | F02M 51/005 239/585.1 |
| 6,196,193 | B1 | 3/2001 | Heinz et al. | |
| 6,367,453 | B1 | 4/2002 | Igashira et al. | |
| 7,234,650 | B2 | 6/2007 | Kuroyanagi et al. | |

(Continued)

FOREIGN PATENT DOCUMENTS

| | | |
|---|---|---|
| EP | 0 925 440 | 6/2002 |

*Primary Examiner* — Arthur O Hall
*Assistant Examiner* — Juan C Barrera
(74) *Attorney, Agent, or Firm* — Faegre Baker Daniels LLP

(57) ABSTRACT

The present disclosure provides a fuel injector for an internal combustion engine with a fuel injector body having a valve chamber, a first conduit in fluid communication with the valve chamber for a first flow of fuel having a first pressure, and a second conduit in fluid communication with the valve chamber for a second flow of fuel having a second pressure. The fuel injector further includes a valve member configured to move between the first conduit and the second conduit. Additionally, an actuator of the fuel injector is configured to move the valve member during a fuel injection cycle. The fuel injector is configured to operate in at least three modes.

17 Claims, 8 Drawing Sheets

(56) References Cited

U.S. PATENT DOCUMENTS

| | | | | |
|---|---|---|---|---|
| 7,318,414 | B2 | 1/2008 | Hou | |
| 7,775,191 | B2 | 8/2010 | Hou | |
| 7,802,588 | B2 * | 9/2010 | Doutt | F16K 11/044 137/606 |
| 7,971,802 | B2 * | 7/2011 | Male | F02M 45/12 239/585.5 |
| 8,215,287 | B2 * | 7/2012 | Lee | F02M 63/0007 123/456 |
| 8,708,249 | B2 * | 4/2014 | Lecluse | F02M 47/025 239/124 |
| 2002/0079378 | A1 * | 6/2002 | Boecking | F02M 63/0005 239/96 |

* cited by examiner

HIGH PRESSURE, HIGH SPEED REGULATING SWITCH VALVE

CROSS-REFERENCE TO RELATED APPLICATIONS

The present application claims the benefit of U.S. Provisional Patent Application Ser. No. 61/993,412, filed May 15, 2014, and entitled "HIGH PRESSURE, HIGH SPEED REGULATING SWITCH VALVE," the complete disclosure of which is expressly incorporated by reference herein.

FIELD OF THE INVENTION

The present disclosure relates to a fuel injector, and more particularly, to a high pressure, high speed regulating switch valve within a fuel injector.

BACKGROUND OF THE DISCLOSURE

Fuel injectors are provided on combustion engines to control fuel flow during a fuel injection event when the engine is operating. Such flow control may be accomplished by controlling the movement of a needle or nozzle valve element of the fuel injector. For example, controlling fuel flow may be accomplished by actuating a piezoelectric actuator or an actuator comprised of a magnetostrictive material.

Manual high pressure valves are available but may be large and have a slow response time, thereby making such valves undesirable in high speed operations in limited space, such as a fuel system operation in a combustion engine of a vehicle. Additionally, the pressure limit on known switch valves may be approximately 300-500 bar, however, some fuel system operations may require a valve with greater pressure limits.

SUMMARY OF THE DISCLOSURE

In one embodiment, a fuel injector for an internal combustion engine comprises a fuel injector body having a valve chamber, a first conduit in fluid communication with the valve chamber for a first flow of fuel having a pressure of at least approximately 300 bar, a second conduit in fluid communication with the valve chamber for a second flow of fuel having a pressure of at least 800 bar, and an outlet port in fluid communication with the valve chamber. The fuel injector further comprises a valve member positioned within the valve chamber which is configured to move between the first conduit and the second conduit. Additionally, an actuator of the fuel injector is coupled to the fuel injector body which is configured to move the valve member within the valve chamber during a fuel injection cycle. The valve member is configured to move toward the second conduit during a first portion of the fuel injection cycle to allow the first flow of fuel to be in fluid communication with the outlet port, and the valve member is configured to move toward the first conduit during a second portion of the fuel injection cycle to allow the second flow of fuel to be in fluid communication with the outlet port.

In a further embodiment, a fuel injector for an internal combustion engine comprises a fuel injector body having a valve chamber, a first conduit in fluid communication with the valve chamber for a first flow of fuel, a second conduit in fluid communication with the valve chamber for a second flow of fuel, and an outlet port in fluid communication with the valve chamber. The fuel injector further comprises a valve member positioned within the valve chamber which is configured to move between the first conduit and the second conduit. Additionally, an actuator of the fuel injector is coupled to the fuel injector body and is configured to move the valve member within the valve chamber during a fuel injection cycle. The valve member is configured to move between the first and second conduits in approximately 0.000001-0.001 seconds, and pressure at the outlet port changes as the valve member moves between the first and second conduits.

In another embodiment, a fuel injector for an internal combustion engine comprises a fuel injector body having a valve chamber, a first conduit in fluid communication with the valve chamber for a first flow of fuel having a first pressure, a second conduit in fluid communication with the valve chamber for a second flow of fuel having a second pressure which is greater than the first pressure, and an outlet port in fluid communication with the valve chamber. The fuel injector further comprises a valve member positioned within the valve chamber and is configured to move between the first conduit and the second conduit. Additionally, an actuator of the fuel injector is coupled to the fuel injector body which is configured to move the valve member within the valve chamber during a fuel injection cycle. The fuel injector is configured to operate in at least three modes. In a first mode, the valve member is configured to move toward the second conduit during at least a first portion of the fuel injection cycle to allow the first flow of fuel to be in fluid communication with the outlet port. In a second mode, the valve member is configured to move toward the first conduit during at least a second portion of the fuel injection cycle to allow the second flow of fuel to be in fluid communication with the outlet port. In a third mode, the valve member is configured to modulate within the valve chamber to allow at least a portion of the first flow of fuel and at least a portion of the second flow of fuel to mix together in the valve chamber such that a pressure at the outlet port is less than the second pressure and greater than the first pressure.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, where.

DETAILED DESCRIPTION OF THE DRAWINGS

The embodiments disclosed below are not intended to be exhaustive or to limit the invention to the precise forms disclosed in the following detailed description. Rather, the embodiments are chosen and described so that others skilled in the art may utilize their teachings.

Figure 1:
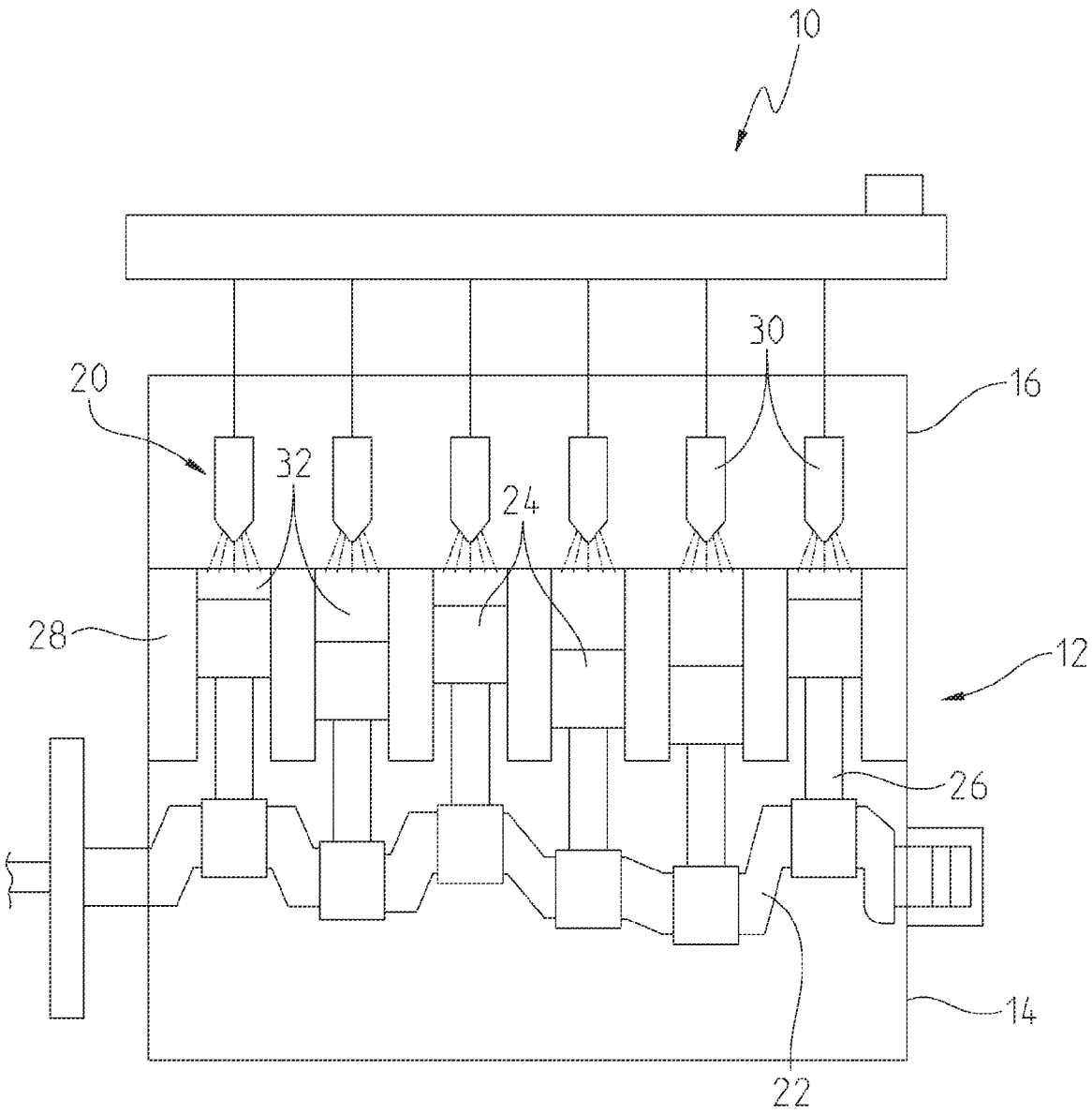
FIG. 1 is a schematic of an internal combustion engine incorporating an exemplary embodiment of a fuel injector of the present disclosure.

Referring to FIG. 1, a portion of an internal combustion engine 10 is shown as a simplified schematic. Engine 10 includes an engine body 12, which supports an engine block 14, a cylinder head 16 coupled to engine block 14, and a fuel system 20. Engine body 12 further includes a crank shaft 22, a plurality of pistons 24, and a plurality of connecting rods 26. Pistons 24 are configured for reciprocal movement within a plurality of engine cylinders 28, with one piston 24 positioned in each engine cylinder 28. Each piston 24 is operably coupled to crank shaft 22 through one of connecting rods 26. A plurality of combustion chambers 32 are each defined by one piston 24, cylinder head 16, and cylinder 28. The movement of pistons 24 under the action of a combustion process in engine 10 causes connecting rods 26 to move crankshaft 22.

When engine 10 is operating, a combustion process occurs in combustion chambers 32 to cause movement of pistons 24. The movement of pistons 24 causes movement of connecting rods 26, which are drivingly connected to crankshaft 22, and movement of connecting rods 26 causes rotary movement of crankshaft 22. The angle of rotation of crankshaft 22 may be measured by the control system to aid in timing the combustion events in engine 10 and for other purposes. The angle of rotation of crankshaft 22 may be measured in a plurality of locations, including a main crank pulley (not shown), an engine flywheel (not shown), an engine camshaft (not shown), or on crankshaft 22.

Fuel system 20 includes a plurality of fuel injectors 30 positioned within cylinder head 16. Each fuel injector 30 is fluidly coupled to one combustion chamber 32. In operation, fuel system 20 provides fuel to fuel injectors 30, which is then injected into combustion chambers 32 by the action of fuel injectors 30, thereby forming one or more injection events or cycles. As detailed further herein, the injection cycle may be defined as the interval that begins with the movement of a nozzle or needle element to permit fuel to flow from fuel injector 30 into an associated combustion chamber 32, and ends when the nozzle or needle element moves to a position to block the flow of fuel from fuel injector 30 into combustion chamber 32.

Crankshaft 22 drives at least one fuel pump to pull fuel from the fuel tank in order to move fuel toward fuel injectors 30. A control system (not shown) provides control signals to fuel injectors 30 that determine operating parameters for each fuel injector 30, such as the length of time fuel injectors 30 operate and the number of fueling pulses per a firing or injection cycle period, thereby determining the amount of fuel delivered by each fuel injector 30.

In addition to fuel system 20, the control system controls, regulates, and/or operates other components of engine 10 that may be controlled, regulated, and/or operated through a control system (not shown). More particularly, the control system may receive signals from sensors located on engine 10 and transmit control signals or other inputs to devices located on engine 10 in order to control the function of such devices. The control system may include a controller or control module (not shown) and a wire harness (not shown). Actions of the control system may be performed by elements of a computer system or other hardware capable of executing programmed instructions, for example, a general purpose computer, special purpose computer, a workstation, or other programmable data processing apparatus. These various control actions also may be performed by specialized circuits (e.g., discrete logic gates interconnected to perform a specialized function), by program instructions (software), such as logical blocks, program modules, or other similar applications which may be executed by one or more processors (e.g., one or more microprocessors, a central processing unit (CPU), and/or an application specific integrated circuit), or any combination thereof. For example, embodiments may be implemented in hardware, software, firmware, middleware, microcode, or any combination thereof. Instructions may be in the form of program code or code segments that perform necessary tasks and can be stored in a non-transitory, machine-readable medium such as a storage medium or other storage(s). A code segment may represent a procedure, function, subprogram, program, routine, subroutine, module, software package, class, or any combination of instructions, data structures, or program statements. A code segment may be coupled to another code segment or a hardware circuit by passing and/or receiving information, data, arguments, parameters, or memory contents. In this way, the control system is configured to control operation of engine 10, including fuel system 20.

Referring to FIGS. 2-6, fuel injector 30 of fuel system 20 includes a fuel injector body 40, an actuator assembly 60, and a valve member, illustratively an upper valve member 70 and a lower valve member or plunger 72. Actuator assembly 60 includes a needle portion 62 and a spring 64. Needle portion 62 is configured for reciprocal movement along a longitudinal axis L of fuel injector 30. More particularly, needle portion 62 is configured to move in response to a signal or other input from the control system and/or another component of engine 10. In one embodiment, actuator assembly 60 may be comprised of a magnetostrictive material and activation of the magnetostrictive material causes needle portion 62 to move along longitudinal axis L. For example, when actuator assembly 60 is "turned on" or energized, the magnetostrictive material therein is activated, thereby causing needle portion 62 to move downwardly in the direction of lower valve member 72. When actuator assembly 60 is "turned off" or de-energized, the magnetostrictive material is no longer activated, thereby allowing needle portion 62 to move upwardly toward spring 64.

Alternatively, actuator assembly 60 may be a piezoelectric device configured to move needle portion 62 along longitudinal axis L. Actuator assembly 60 may include a solenoid valve or other similar device for energizing and de-energizing actuator assembly 60. Illustratively, actuator assembly 60 is a DA2 piezoelectric device. When actuator assembly 60 is "turned on" or energized, the piezoelectric device provides a force on needle portion 62, which moves needle portion 62 downwardly in the direction of lower valve member 72. When actuator assembly 60 is "turned off" or de-energized, the force from the piezoelectric device is released and needle portion 62 moves upwardly toward spring 64.

Figure 2:
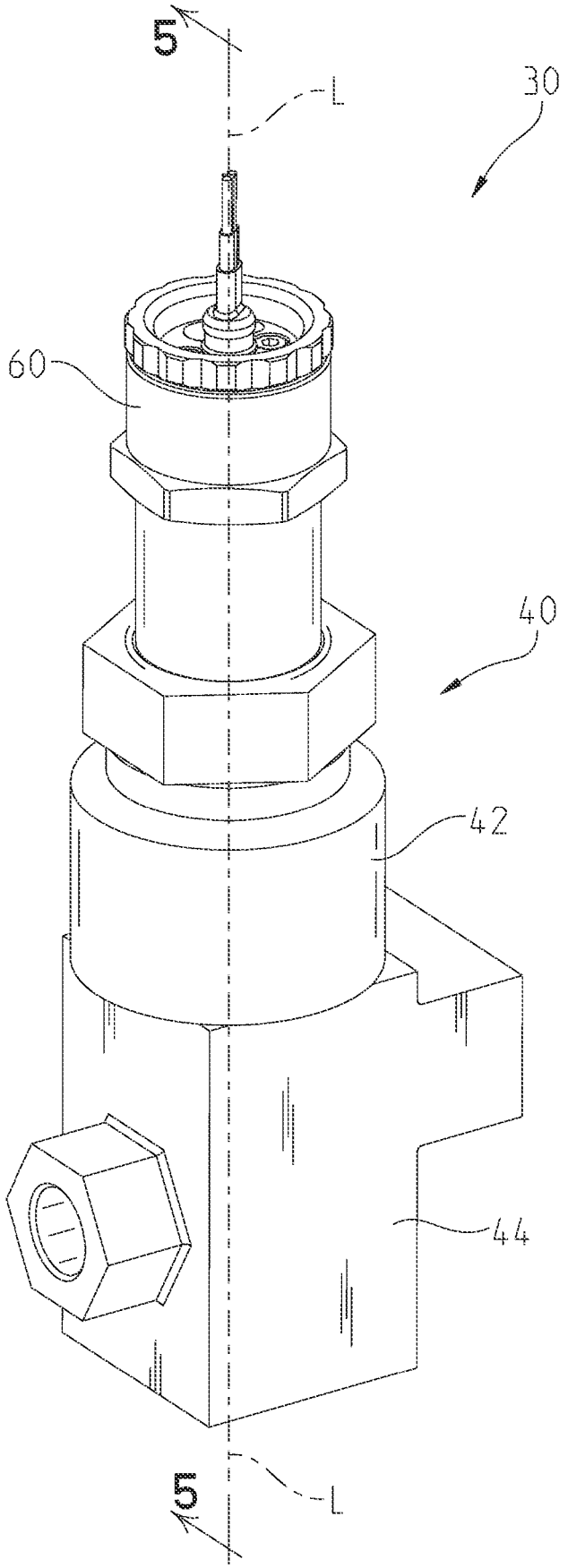
FIG. 2 is a front right perspective view of the fuel injector of the present disclosure.
Figure 3:
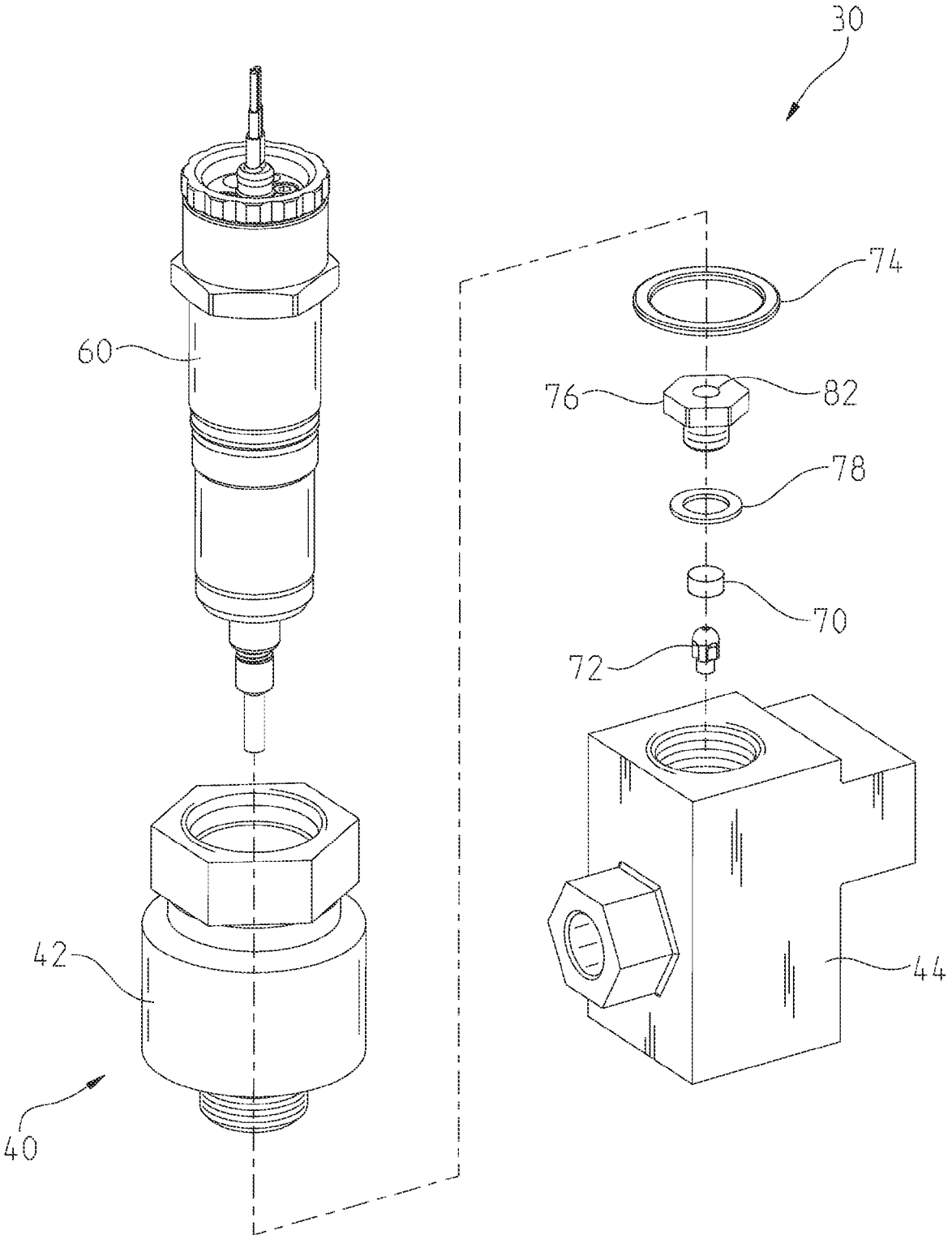
FIG. 3 is an exploded view of the fuel injector of FIG. 2.
Figure 5:
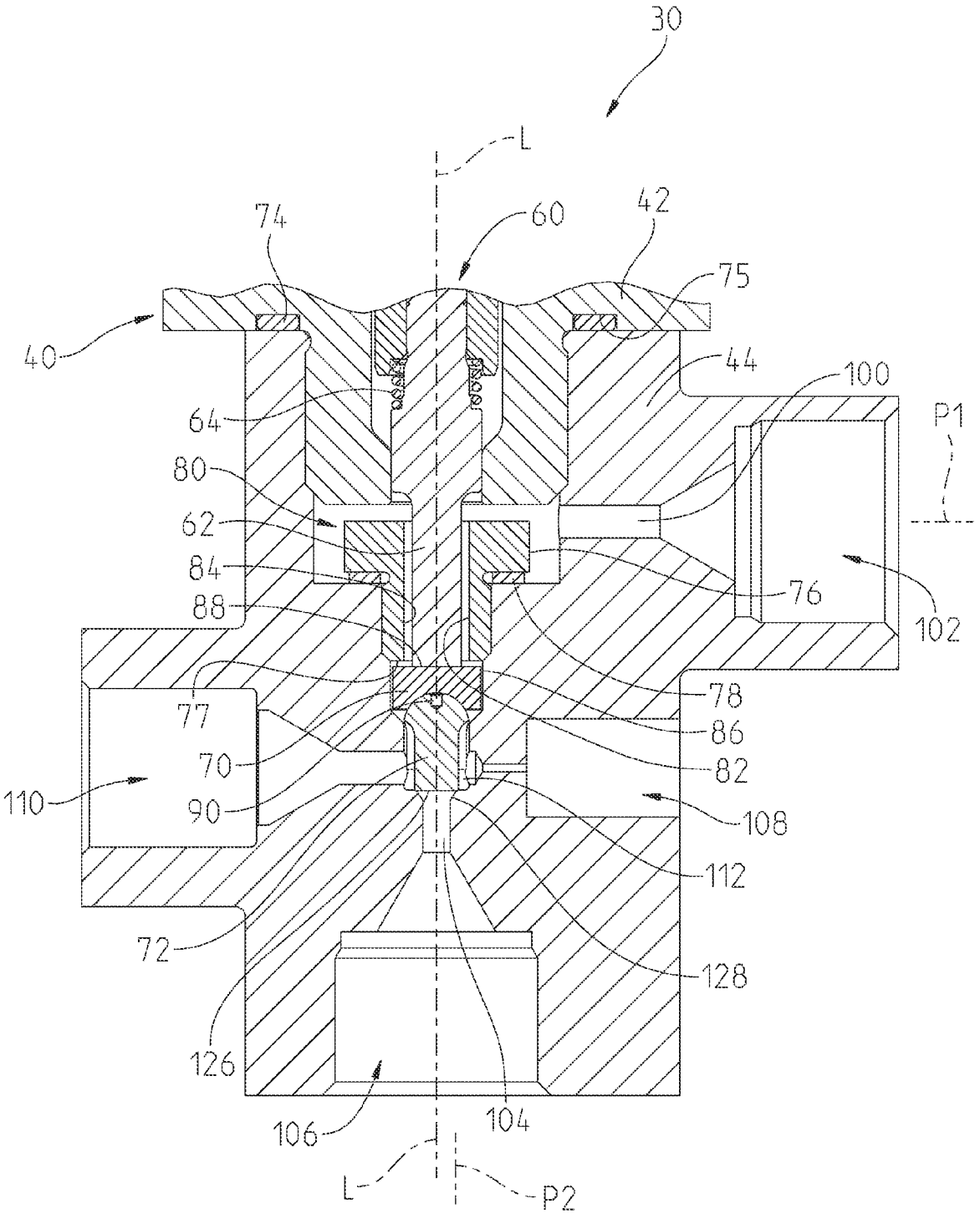
FIG. 5 is a cross-sectional view of the fuel injector of FIG. 2, taken along line 5-5 of FIG. 2, with the valve member closed against a second conduit.
Figure 6:
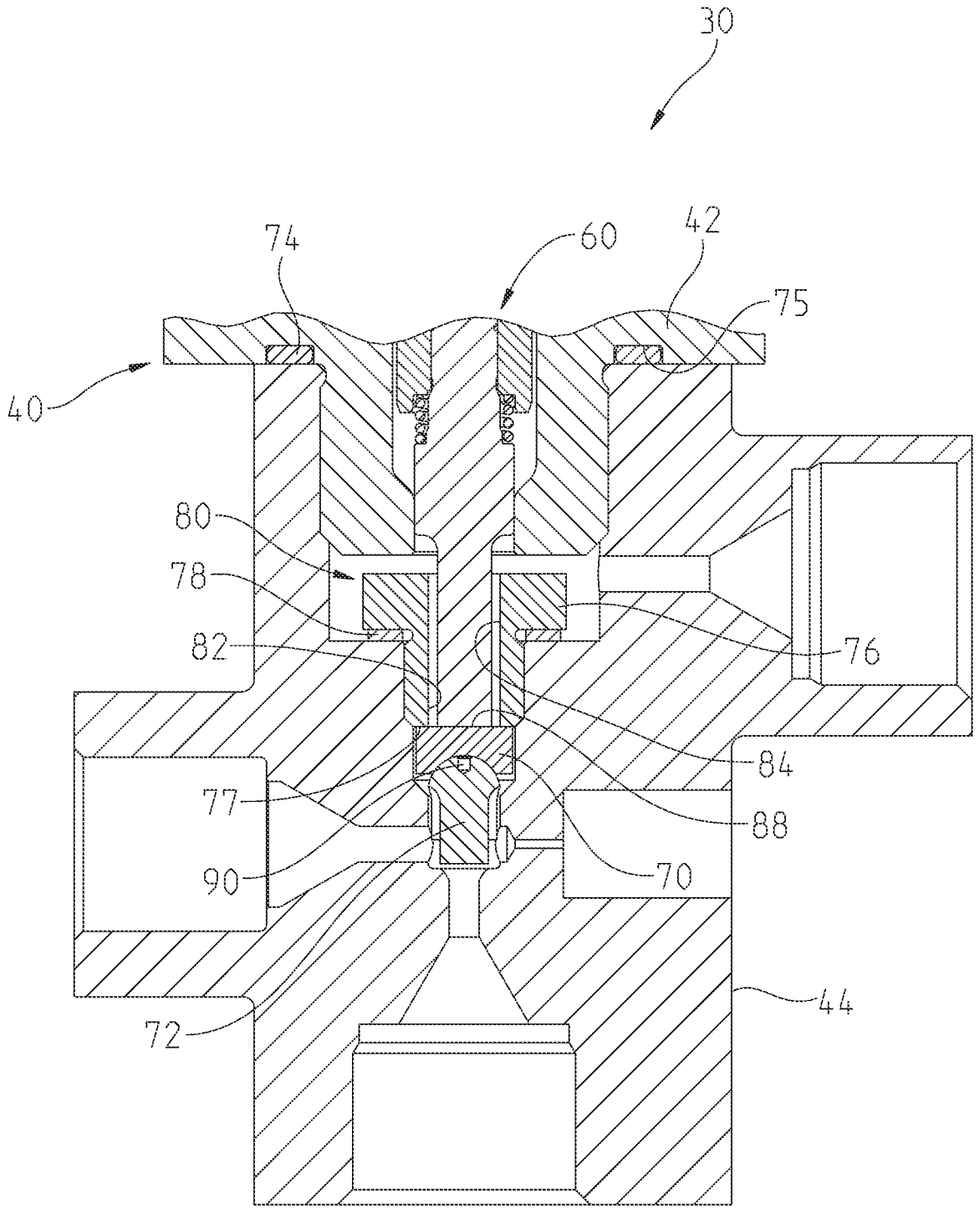
FIG. 6 is a cross-sectional view of the fuel injector of FIG. 2, with the valve member closed against a first conduit.

Referring to FIG. 2, fuel injector body 40 includes an upper housing 42 and a lower housing 44. Upper housing 42 is coupled to lower housing 44, and both upper and lower housings 42, 44 support actuator assembly 60. As shown in FIGS. 3, 5, and 6, a shim or spacer 74 is positioned between upper and lower housings 42, 44. In an exemplary embodiment, shim 74 is positioned on the top surface of lower housing 44 and within a groove 75 along the bottom surface of upper housing 42. As detailed further herein, shim 74 may set the stroke of actuator assembly 60. In one embodiment, the stroke of actuator assembly 60 may be approximately 90 microns.

As shown in FIGS. 5 and 6, lower housing 44 supports a needle valve element 76 and a washer or spacer 78. Illustratively, as shown in FIG. 5, upper housing 42 extends into a fuel chamber 80 of lower housing 44 and is positioned above needle valve element 76. Needle valve element 76 is positioned above spacer 78 and is in contact therewith. Needle valve element 76 includes a cylindrical opening 82 which is configured to receive needle portion 62 of actuator assembly 60. In an illustrative embodiment, needle portion 62 of actuator assembly 60 extends through opening 82 and contacts upper valve member 70, as detailed further herein. As shown in FIGS. 5 and 6, the diameter of opening 82 is greater than the diameter of needle portion 62 such that an upper fuel passageway 84 is defined around needle portion 62. As detailed further herein, during operation of fuel injector 30, a bottom surface 77 of needle valve element 76 may contact upper valve member 70 in order to prevent fuel from passing through upper fuel passageway 84.

Lower housing 44 further includes a first conduit or fuel passageway 100 fluidly coupled to a first pressure source P1, for example a fuel pump, rail, and/or accumulator. First conduit 100 includes a first inlet port 102 coupled to first pressure source P1 through a fuel line, for example a 20-mm high pressure line. Illustratively, first conduit 100 is fluidly coupled to upper fuel passageway 84 and is positioned laterally outward of actuator assembly 60 and needle valve element 76. As shown in FIG. 5, first conduit 100 is generally perpendicular to longitudinal axis L. In one embodiment, first conduit 100 is configured as a low-pressure passageway, such that fuel flowing through first conduit 100 has a pressure of approximately 300-2,000 bar. In the illustrative embodiment, the pressure of the fuel through first conduit 100 is 180 bar to 500 bar inclusive, 240 bar to 300 bar inclusive, and 300 bar.

Lower housing 44 also includes a second conduit or fuel passageway 104 and a second inlet port 106 supported at a lower position on housing 44 relative to first conduit 100. Illustratively, second inlet port 106 is positioned along the bottom surface of lower housing 44 and second conduit 104 extends along longitudinal axis L. Second conduit 104 is fluidly coupled to a second pressure source P2, for example a fuel pump, rail, and/or accumulator. Second conduit 104 may be coupled to second pressure source P2 through a fuel line, for example a 20-mm high pressure line. In one embodiment, second conduit 104 is configured as a high-pressure passageway, such that fuel flowing through second conduit 104 has a pressure of approximately 300 bar to 3,000 bar. In the illustrative embodiment, the pressure of the fuel through second conduit 104 is 600 bar to 3,000 bar inclusive, 800 bar to 2,400 bar inclusive, 1,000 bar to 1,800 bar inclusive, and 1,200 bar.

Lower housing 44 further includes a drain port 108 positioned laterally outward from longitudinal axis L and below first conduit 100. Illustratively, drain port 108 is parallel to first conduit 100 and first inlet port 102, and is generally perpendicular to longitudinal axis L and second conduit 104. Drain port 108 is fluidly coupled to an accumulator volume to accommodate excess fuel within lower housing 44 after an injection cycle, as detailed further herein.

Generally opposite drain port 108 is an outlet or load port 110 positioned laterally outward from and perpendicular to longitudinal axis L. Outlet port 110 is configured to supply the fuel from first and/or second conduits 100, 104 to combustion chambers 32 of engine 10, as detailed further herein. In one embodiment, outlet port 110 may be fluidly coupled to an injector portion (not shown) of fuel injector 30 in order to introduce the fuel into combustion chamber 32.

Lower housing 44 also includes a valve chamber 112 in fluid communication with first conduit 100, second conduit 104, drain port 108, and outlet port 110. Illustratively, valve chamber 112 is positioned intermediate first conduit 100, second conduit 104, drain port 108, and outlet port 110, and generally extends along longitudinal axis L. As shown in FIGS. 5 and 6, lower valve member 72 is positioned within valve chamber 112 and is configured to move along longitudinal axis L within valve chamber 112, as detailed further herein.

Referring to FIG. 3, upper valve member 70 may have a cylindrical shape and generally defines a circle in cross-section. In an alternative embodiment, upper valve member 70 may define other shapes in cross-section, for example a rectangle. Upper valve member 70 is positioned below upper fuel passageway 84 and within a lower fuel passageway 86, as shown in FIG. 5. More particularly, the diameter of upper valve member 70 is less than the diameter of lower fuel passageway 86 such that fuel may flow through lower fuel passageway 86, as detailed further herein. In one embodiment, upper valve member 70 is positioned intermediate needle portion 62 and lower valve member 72. In particular, an upper surface of upper valve member 70 is in contact with needle portion 62 of actuator assembly 60. Additionally, the upper surface of upper valve member 70 may be configured to contact lower surface 77 of needle valve element 76. In this way, the upper surface of upper valve member 70 defines a first valve seat 88, which when sealed against lower surface 77 of needle valve element 76, prevents the flow of fuel through upper fuel passageway 84. Because the upper surface of upper valve member 70 is flat, first valve seat 88 has a flat or planar configuration. A lower surface of upper valve member 70 is in contact with lower valve member 72 and may be coupled thereto with a coupler 90, as shown in FIGS. 5 and 6.

Figure 4:
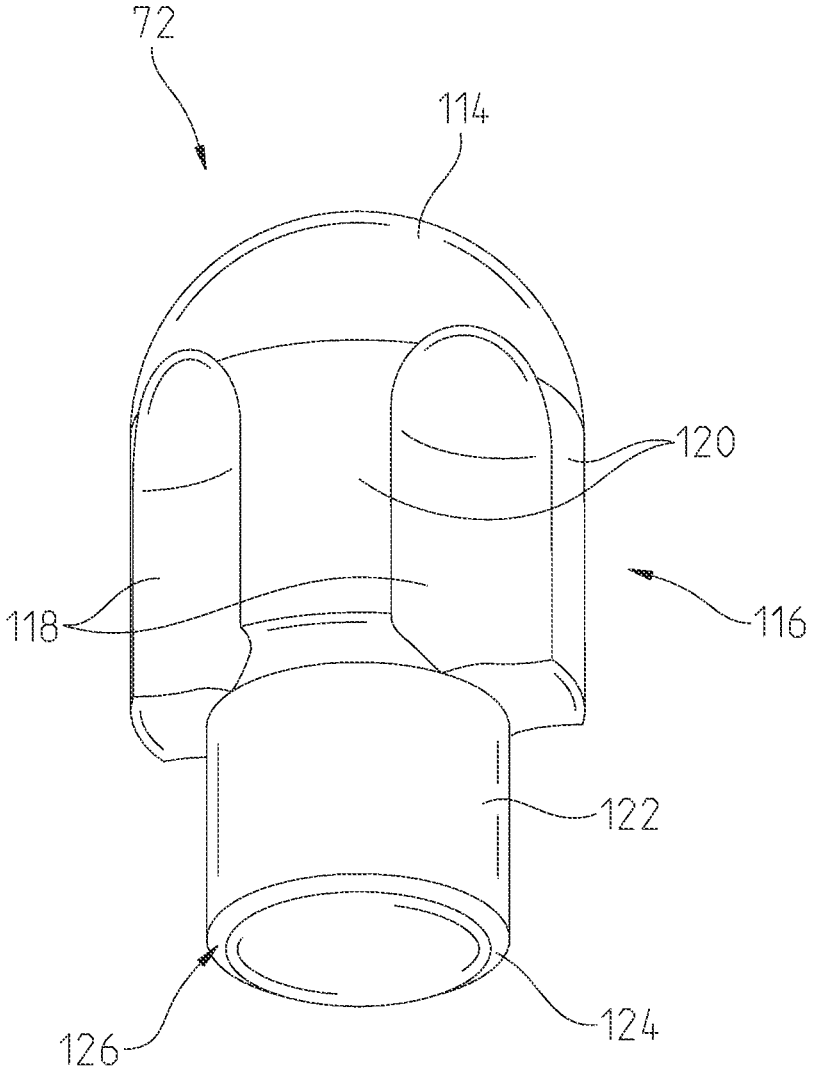
FIG. 4 is a front right perspective view of a valve member of the fuel injector of FIG. 2.

Referring now to FIGS. 4-6, lower valve member 72 is positioned within valve chamber 112 of lower housing 44. In one embodiment, lower valve member 72 includes a rounded or curved upper surface 114. Upper surface 114 of lower valve member 72 may be coupled to the lower surface of upper valve member 70 with coupler 90. Lower valve member 70 also includes a guided portion 116 which extends downwardly within valve chamber 112. Guided portion 116 includes a plurality of cut-outs or indentations, illustratively fluted recesses 118 and a plurality of ribs 120 extending outwardly and positioned intermediate fluted recesses 118. The outer diameter of illustrative guided portion 116 is approximately 8.5 mm. Fluted recesses 118 are configured to allow fuel to flow around lower valve member 72 and pass through valve chamber 112. Lower valve member 72 also includes a lower surface 122 which is generally rounded. Illustratively, lower surface 122 is cylindrical and defines a circle in cross-section. Lower surface 122 includes a tapered bottom edge 124, which is illustratively tapered at approximately 120 degrees to define a second valve seat 126. In one embodiment, the diameter of second valve seat 126 is approximately 3.5 mm. Second valve seat 126 is configured to seal against second conduit 104, as detailed further herein. Illustratively, second valve seat 126 has an angled or conical configuration.

Fuel injector 30 is configured to operate in at least three modes of operation. The first mode of operation includes supplying only low-pressure fuel to combustion chamber 32 during an injection cycle. In particular, when fuel injector 30 is in the first mode, only fuel from first conduit 100 flows through outlet port 110 and into combustion chamber 32, as shown in FIG. 5. The second mode of operation includes supplying only high-pressure fuel to combustion chamber 32 during an injection cycle. In particular, when fuel injector 30 is in the second mode, only fuel from second conduit 104 flows through outlet port 110 and into combustion chamber 32, as shown in FIG. 6. The third mode of operation includes periodically supplying both high- and low-pressure fuel to combustion chamber 32 during an injection cycle. In particular, when fuel injector 30 is in the third mode, fuel injector 30 is able to switch between the low-pressure supply from first conduit 100 and the high-pressure supply from second conduit 104 during an injection cycle. Additionally, fuel injector 30 also may be configured to regulate the pressure at outlet port 110 by modulating upper and lower valve members 70, 72 during an injection cycle.

Referring to FIG. 5, during operation of engine 10, if only a low-pressure fuel supply is required, fuel injector 30 is used in the first mode of operation. When in the first mode of operation, a fuel injection cycle begins when actuator assembly 60 is energized or "turned on," which causes needle portion 62 to move downwardly toward valve chamber 112. More particularly, the pressure exerted on lower valve member 72 by actuator assembly 60 is greater than the opposing pressure from any fuel flowing through second conduit 104 such that lower valve member 72 is pushed downwardly. When needle portion 62 moves downwardly along longitudinal axis L, upper and lower valve members 70, 72 also move downwardly such that second valve seat 126 seals against an upper edge 128 of second conduit 104. Illustratively, upper edge 128 of second conduit 104 is tapered in order to seal against tapered bottom edge 124 of lower valve member 72, as shown in FIG. 5. As such, second valve seat 126 does not allow fuel from second pressure source P2 to flow through second conduit 104 and into valve chamber 112. In other words, when actuator assembly 60 is energized, upper and lower valve members 70, 72 move downwardly to close second conduit 104.

As upper and lower valve members 70, 72 move downwardly to close second conduit 104, first valve seat 88 moves away from lower surface 77 of needle valve element 76. As such, upper fuel passageway 84 is open and fuel from first pressure source P1 flows through first conduit 100 and into fuel chamber 80 in order to flow around needle portion 62 of actuator assembly 60 and through upper fuel passageway 84. The fuel from first conduit 100 continues to flow through upper fuel passageway 84 and into lower fuel passageway 86 such that the fuel flows around upper valve element 70 and downwardly around lower valve element 72 in valve chamber 112. Once the fuel from first conduit 100 flows into valve chamber 112, the fuel flows through outlet port 110 and into combustion chamber 32 of engine 10 to facilitate the combustion process.

A fuel injection cycle during the first mode of operation may have a duration of approximately 0.003 seconds. Once the fuel injection cycle is complete, for example approximately 0.003 seconds after actuator assembly 60 was energized or "turned on," actuator assembly 60 is de-energized or "turned off" to complete the fuel injection cycle. When actuator assembly 60 is de-energized, the downward force on needle portion 62 is released and needle portion 62 lifts upwardly through needle valve member 76. More particularly, when actuator assembly 60 is de-energized, spring 64 is no longer compressed, and as spring 64 elongates, the bias of spring 64 causes needle portion 62 to lift upwardly. The upward movement of needle portion 62 causes first valve seat 88 to seal against lower surface 77 of needle valve element 76. In this way, fuel from first conduit 100 no longer flows into valve chamber 112 and the fuel injection cycle in the first mode of operation is complete. Any residual or excess fuel remaining in valve chamber 112 after an injection cycle may pass through drain port 108 and into a reservoir or accumulator (not shown) for use in a later injection cycle.

Alternatively, if only a high-pressure fuel supply is required during operation of engine 10, fuel injector 30 is used in the second mode of operation. Referring to FIG. 6, when in the second mode of operation, a fuel injection cycle begins when fuel from second pressure source P2 flows though second conduit 104 and into valve chamber 112. Actuator assembly 60 is not energized during the second mode of operation and the pressure of the fuel from second pressure source P2 is sufficient to push or move upper and lower valve members 70, 72 upwardly along longitudinal axis L until first valve seat 88 contacts lower surface 77 of needle valve element 76, thereby closing first conduit 100. In this way, only fuel from second pressure source P2 flows into valve chamber 112 and through outlet port 110.

A fuel injection cycle during the second mode of operation also may have a duration of approximately 0.003 seconds. Once the fuel injection cycle is complete, for example approximately 0.003 seconds after second conduit 104 was opened and valve seat 88 closed first conduit 100, the flow of fuel from second conduit 104 is prevented from entering valve chamber 112, which completes the fuel injection cycle. For example, when the fuel injection cycle of the second mode is complete, the control system may send a signal to stop the flow of fuel from second pressure source P2 or, alternatively, may energize actuator assembly 60 in order to move upper and lower valve members 70, 72 downwardly to sealingly close second conduit 104. In this way, fuel from second conduit 104 no longer flows into valve chamber 112 when the fuel injection cycle in the second mode of operation is complete. Any residual or excess fuel remaining in valve chamber 112 after an injection cycle may pass through drain port 108 and into a reservoir or accumulator for use in a later injection cycle. It may be appreciated that throughout operation of fuel system 20, upper and lower valve members 70, 72 only move in response to actuator assembly 60 and the pressure from second pressure source P2. As such, no external devices, such as springs or guides, are required to move upper and lower valve members 70, 72.

If operation of engine 10 requires variable fuel pressure, for example that both high- and low-pressure fuel should be provided to combustion chamber 32, then fuel injector 30 operates in the third mode of operation to periodically switch the flow of fuel entering outlet port 110 and combustion chamber 32 during an injection cycle. As such, fuel injector 30 is configured to vary the fuel pressure during a single injection cycle such that the pressure at outlet port 110 changes during the injection cycle. In one embodiment, if it is required or desirable to begin a fuel injection cycle with low-pressure fuel, then actuator assembly 60 is energized or "turned on" to cause needle portion 62 to move downwardly such that second valve seat 126 seals against upper edge 128 of second conduit 104 to close second conduit 104. As such, the fuel injection cycle begins by flowing low-pressure fuel from first pressure source P1 into combustion chamber 32 through valve chamber 112 and outlet port 110, as shown in FIG. 5. At a predetermined time, for example, approximately 0.0015 seconds after the injection cycle begins, it may be necessary or desirable to switch the flow of fuel entering combustion chamber 32 from the low-pressure fuel to the high-pressure fuel in second pressure source P2 for the second half of the injection cycle. As such, at the predetermined time, actuator assembly 60 may be de-energized or "turned off," thereby causing the pressure from second pressure source P2 to push or move upper and lower valve members 70, 72 upwardly to close upper fuel passageway 84 and first conduit 100. In this way, the high-pressure fuel from second pressure source P2 flows into combustion chamber 32 through second conduit 104, valve chamber 112, and outlet port 110, as shown in FIG. 6. When the injection cycle is complete, the supply of fuel from second pressure source P2 is stopped. Any residual or excess fuel remaining in valve chamber 112 after the injection cycle may pass through drain port 108 and into a reservoir or accumulator for use in a later injection cycle.

While the third mode of operation was described with a predetermined switching time of approximately 0.0015 seconds, the switch between the low- and high-pressure fuel may occur at any time during an injection cycle. For example, the predetermined switching time may be established at 0.001 seconds after the injection cycle begins, or alternatively, may be established at 0.002 seconds after the injection cycle begins.

It may be appreciated that fuel injector 30 is configured to switch between the low- and high-pressure flows of fuel during a single fuel injection cycle or event. As such, fuel injector 30 switches between the low- and high-pressure flows of fuel at a high a speed. For example, the high-speed switching function of fuel injector 30 may take approximately 0.000001-0.001 seconds to switch the flow of fuel entering combustion chamber 32 from the low-pressure flow to the high-pressure flow. In one embodiment, the high-speed switching function of fuel injector 30 may take approximately $10^{-6}$ to $10^{-3}$ seconds inclusive, $1*10^{-3}$ to $5*10^{-3}$ seconds inclusive, and a time less than $5*10^{-5}$ seconds to switch the flow of fuel entering combustion chamber 32 from the low-pressure flow to the high-pressure flow. Illustratively, fuel injector 30 is configured to switch between the low- and high-pressure fuel flows in approximately 0.000050 seconds. As such, fuel injector 30 is configured to switch or change the flow of fuel into combustion chamber 32 with a high-pressure fuel source and at a high speed.

Alternatively, fuel injector 30 may be configured to regulate the pressure of the fuel entering combustion chamber 32 by modulating or periodically adjusting the movement of upper and lower valve members 70, 72. For example, actuator assembly 60 may be configured to pulse upper and lower valve members 70, 72 within lower housing 44 in order to periodically allow fuel from first pressure source P1 to flow into valve chamber 112 and periodically allow fuel from second pressure source P2 to flow into valve chamber 112. The pulsing action of upper and lower valve members 70, 72 along longitudinal axis L may occur at high speeds such that fuel from first pressure source P1 and fuel from second pressure source P2 enter valve chamber 112 at approximately the same time. In this way, fuel from first pressure source P1 may mix with fuel from second pressure source P2 in valve chamber 112 such that a combined flow of fuel from first and second pressure sources P1, P2 enters outlet port 110 and combustion chamber 32. It may be appreciated that the pressure of this combined flow of fuel may be regulated to a pressure that is greater than the pressure from first pressure source P1 and less than the pressure from second pressure source P2. As such, fuel injector 30 is configured to regulate the pressure of the flow of fuel into combustion chamber 32 to a specific or predetermined pressure by controlling the modulation or movement of upper and lower valve members 70, 72.

Figure 7:
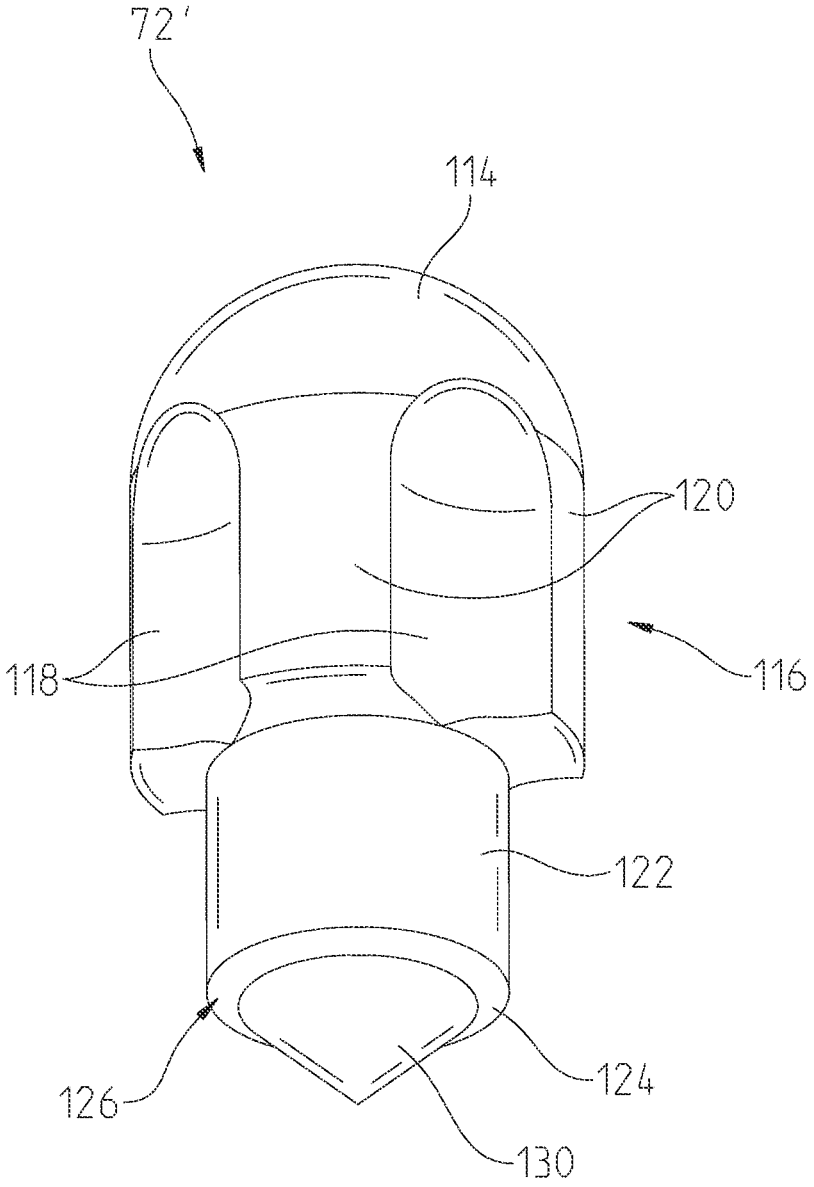
FIG. 7 is a front right perspective view of an alternative embodiment of the valve member of FIG. 4.
Figure 8:
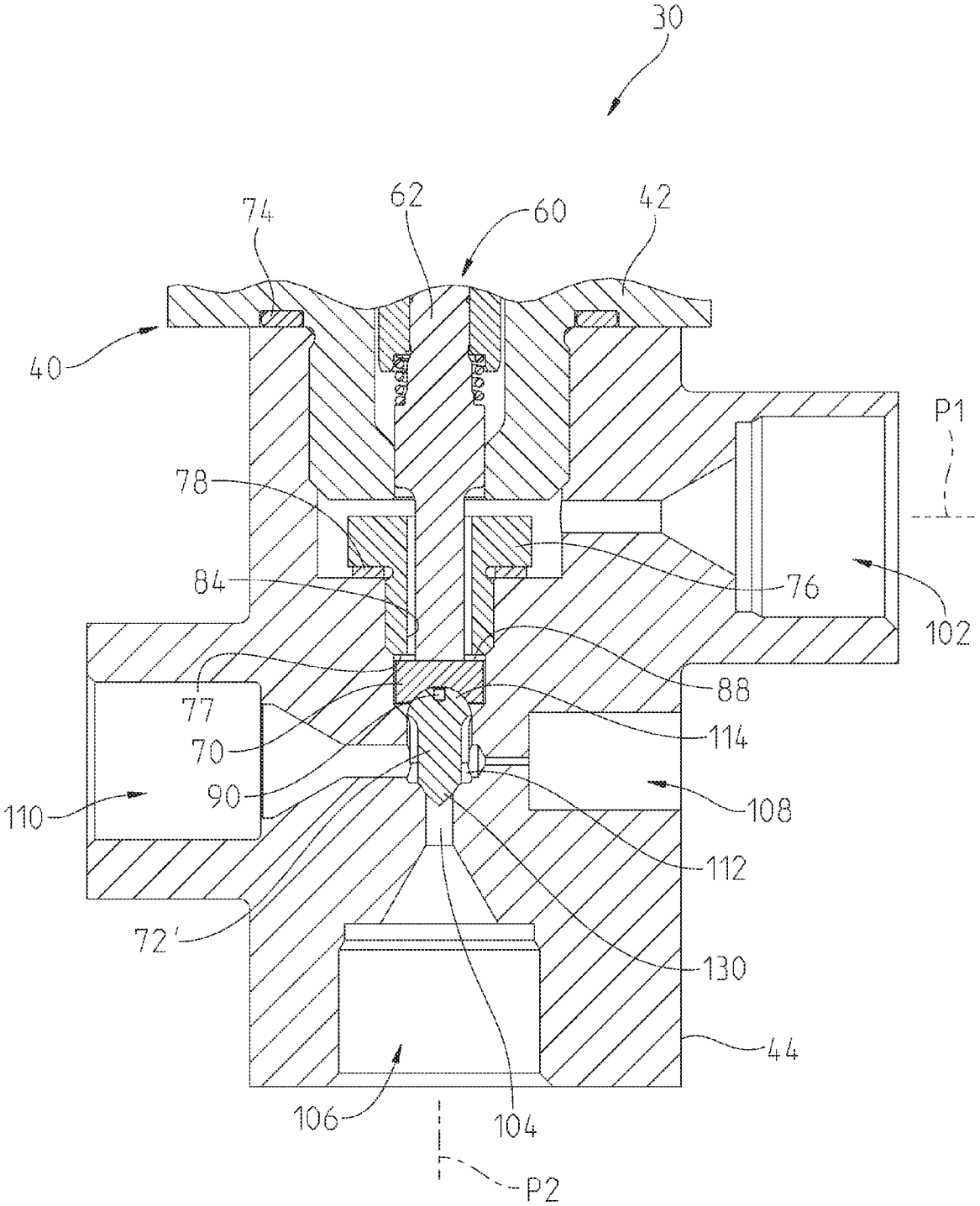
FIG. 8 is a cross-sectional view of the fuel injector of FIG. 2, with the valve member of FIG. 7 closed against the second conduit.

Referring to FIGS. 7 and 8, an alternative embodiment of lower valve member 72 is shown as lower valve member 72' and may be used in fuel injector 30. Similar to lower valve member 72, the alternative embodiment lower valve member 72' includes rounded or curved upper surface 114, guided portion 116, and lower surface 122. More particularly, as shown best in FIG. 8, curved upper surface 114 of lower valve member 72' is coupled to upper valve member 70 with a coupler 90. Additionally, as shown best in FIG. 7, guided portion 116 of lower valve member 72' includes cut-out portions, illustratively fluted cut-out portions 118, and ribs 120 positioned intermediate fluted cut-out portions 118. Additionally, lower surface 122 includes tapered bottom surface 124 to define second valve seat 126. Illustratively, tapered bottom surface 124 may be angled approximately 120 degrees and is configured to seal against upper edge 128 of second conduit 104.

Lower valve member 72' further includes a protrusion 130 extending from tapered bottom surface 124. More particularly, protrusion 130 is a conical protrusion with a circular cross-section having a diameter that decreases with distance from tapered bottom surface 124 to a pointed end which defines the lower-most surface of lower valve member 72'. Protrusion 130 is configured to fit within second conduit 104 when second valve seat 126 is sealed against upper edge 128 of second conduit 104, as shown in FIG. 8. For example, when fuel injector 30 operates in at least the first mode of operation, lower valve member 72' closes second conduit 104 to prevent the high-pressure fuel from second pressure source P2 from flowing into combustion chamber 32. In particular, when second valve seat 126 seals against upper edge 128 of second conduit 104 in order to close second conduit 104, protrusion 130 extends into second conduit 104 to further prevent fuel therein from flowing into valve chamber 112.

It may be appreciated that when fuel injector 30 is operating in at least the second mode of operation to allow fuel from second pressure source P2 to flow into combustion chamber 32 through second conduit 104, the shape and configuration of protrusion 130 may advantageously direct the fuel from second conduit 104 into valve chamber 112 and outlet port 110.

As with lower valve member 72, the alternative embodiment lower valve member 72' also is configured to switch at high speeds between the flow of fuel from first pressure source P1 and the flow of fuel from second pressure source P2. As such, when fuel injector 30 includes lower valve member 72', fuel injector 32 is still configured to vary the pressure at outlet port 110 during a single injection cycle. For example, the high-speed switching function of fuel injector 30 with lower valve member 72' may take approximately 0.000050-0.001 seconds to switch the flow of fuel entering combustion chamber 32 from the low-pressure flow to the high-pressure flow. Illustratively, fuel injector 30 is configured to switch between the low- and high-pressure fuel flows in approximately 0.000050 seconds. Additionally, lower valve member 72' is configured to regulate the pressure within valve chamber 112, as detailed herein.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A fuel injector for an internal combustion engine, comprising:

a fuel injector body having:

a valve chamber;

a first conduit in fluid communication with the valve chamber, the first conduit fluidly coupled to a first fuel source having a first pressure greater than 300 bar;

a second conduit in fluid communication with the valve chamber, the second conduit fluidly coupled to a second fuel source having a second pressure greater than the first pressure; and an outlet port in fluid communication with the valve chamber;

a valve member positioned within the valve chamber and configured to fluidly couple the valve chamber to the first conduit in a first position allowing fuel to flow from the first fuel source through the outlet port, and to fluidly couple the valve chamber to the second conduit in a second position allowing fuel to flow from the second fuel source through the outlet port, wherein the first position comprises the valve member positioned toward the second conduit, and wherein the second position comprises the valve member positioned toward the first conduit; and a single actuator coupled to the fuel injector body and configured to move the valve member such that the valve member is in each of the first position and the second position during distinct portions of a single fuel injection event, wherein the fuel injector body further comprises an upper housing for supporting a first portion of the actuator and a lower housing for supporting a second portion of the actuator, a shim positioned between the upper and lower housings, and the arrangement of the shim is configured to regulate movement of the actuator during the fuel injection cycle.

2. The fuel injector of claim 1, wherein the first pressure comprises a pressure value between 300 and 2,000 bar inclusive, and the second pressure comprises a pressure value between 800 and 3,000 bar inclusive.

3. The fuel injector of claim 1, wherein the second pressure comprises a pressure within a pressure range selected from the pressure ranges consisting of 600 bar to 3,000bar inclusive, 800 bar to 2,400 bar inclusive, 1,000 bar to 1,800 bar inclusive, and 1,200 bar.

4. The fuel injector of claim 1, wherein the first pressure comprises a pressure within a pressure range selected from the pressure range consisting of 301 bar to 500 bar inclusive.

5. The fuel injector of claim 1, wherein the valve member further comprises a first end having an angled valve seat and a second end having a planar valve seat.

6. The fuel injector of claim 1, wherein the valve member is configured to move between the first position and the second position within a time range selected from the time ranges consisting of $10^{-6}$ to $10^{-3}$ seconds inclusive, $1*10^{-3}$ to $5*10^{-3}$ seconds inclusive, and a time less than $5*10^{-5}$ seconds.

7. A fuel injector for an internal combustion engine, comprising:

a fuel injector body having:

a valve chamber;

a first conduit in fluid communication with the valve chamber and fluidly coupled to a first fuel source;

a second conduit in fluid communication with the valve chamber and fluidly coupled to a second fuel source; and an outlet port in fluid communication with the valve chamber;

a valve member positioned within the valve chamber and configured to move between the first conduit and the second conduit; and a single actuator coupled to the fuel injector body and configured to fluidly couple the valve chamber to the first conduit by moving the valve member to a first position, and to fluidly couple the valve chamber to the second conduit by moving the valve member to a second position, the valve member being configured to move between the first and second positions within a time range selected from the time ranges consisting of $10^{-6}$ to $10^{-3}$ seconds inclusive, $1*10^{-3}$ to $5*10^{-3}$ seconds inclusive, and a time less than $5*10^{-5}$ seconds, and pressure at the outlet port changes as the valve member moves between the first and second positions, wherein the fuel injector body further comprises an upper housing for supporting a first portion of the actuator and a lower housing for supporting a second portion of the actuator, a shim positioned between the upper and lower housings, and the arrangement of the shim is configured to regulate movement of the actuator during the fuel injection cycle.

8. The fuel injector of claim 7, wherein the first fuel source has a first pressure comprising a pressure value within a pressure range selected from the pressure ranges consisting of 180 bar to 500 bar inclusive, 240 bar to 300 bar inclusive, and 300 bar.

9. The fuel injector of claim 8, wherein second fuel source has a second pressure comprising a pressure value within a pressure range selected from the pressure ranges consisting of 600 bar and 3,000 bar inclusive, 800 bar and 2,400 bar inclusive, 1,000 bar and 1,800 bar inclusive, and 1,200 bar.

10. The fuel injector of claim 9, wherein the valve member is configured to move toward the second conduit during a first portion of a fuel injection cycle such that pressure at the outlet port is approximately 300 bar, and the valve member is configured to move toward the first conduit during a second portion of the fuel injection cycle such that the pressure at the outlet port is approximately 1,200 bar.

11. The fuel injector of claim 10, wherein the actuator is configured to modulate the valve member within the valve chamber such that at least a portion of a first flow of fuel from the first fuel source and at least a portion of a second flow of fuel from the second fuel source mix together in the valve chamber, and the pressure at the outlet port is regulated to a pressure of between 300 bar and 1,200 bar inclusive.

12. A fuel injector for an internal combustion engine, comprising:

a fuel injector body having:

a valve chamber;

a first conduit in fluid communication with the valve chamber and fluidly coupled to a first fuel source having a first pressure;

a second conduit in fluid communication with the valve chamber and fluidly coupled to a second fuel source having a second pressure, the second pressure being greater than the first pressure; and an outlet port in fluid communication with the valve chamber;

a valve member positioned within the valve chamber and configured to fluidly couple the valve chamber to the first conduit in a first position, and to fluidly couple the valve chamber to the second conduit in a second position; and a single actuator coupled to the fuel injector body and configured to move the valve member such that the valve member is in each of the first position and the second position during distinct portions of a single fuel injection event, the fuel injector being configured to operate in at least three modes, wherein in a first mode, the valve member is positioned toward the second conduit during a first portion of the fuel injection event and fuel from the first fuel source is in fluid communication with the outlet port, in a second mode, the valve member is positioned toward the first conduit during a second portion of the fuel injection event and fuel from the second fuel source is in fluid communication with the outlet port, and in a third mode, the single actuator modulates the valve member between the first and second positions such that at least a portion of the fuel from the first fuel source and at least a portion of the fuel from the second fuel source mix together in the valve chamber, and a pressure at the outlet port is less than the second pressure and greater than the first pressure, wherein, when in the third mode, the valve member is configured to move between the first position and the second position within a time range selected from the time ranges consisting of $10^{-6}$ to $10^{-3}$ seconds inclusive, $1*10^{-3}$ to $5*10^{-3}$ seconds inclusive, and a time less than $5*10^{-5}$ seconds, wherein the fuel injector body further comprises an upper housing for supporting a first portion of the actuator and a lower housing for supporting a second portion of the actuator, a shim positioned between the upper and lower housings, and the arrangement of the shim is configured to regulate movement of the actuator during the fuel injection cycle.

13. The fuel injector of claim 12, wherein the first pressure comprises a pressure value between 300 and 2,000 bar inclusive, and the second pressure comprises a pressure value between 800 and 3,000 bar inclusive.

14. The fuel injector of claim 12, wherein the second pressure comprises a pressure within a pressure range selected from the pressure ranges consisting of 600 bar to 3,000 bar inclusive, 800 bar to 2,400 bar inclusive, 1,000 bar to 1,800 bar inclusive, and 1,200 bar.

15. The fuel injector of claim 12, wherein the first pressure comprises a pressure within a pressure range selected from the pressure ranges consisting of 180 bar to 500 bar inclusive, 240 bar to 300 bar inclusive, and 300 bar.

16. The fuel injector of claim 12, wherein the valve member further comprises a first end having an angled valve seat and a second end having a planar valve seat.

17. A fuel injector for an internal combustion engine, comprising:

a fuel injector body having:

a valve chamber;

a first conduit in fluid communication with the valve chamber and fluidly coupled to a first fuel source having a first pressure;

a second conduit in fluid communication with the valve chamber and fluidly coupled to a second fuel source having a second pressure, the second pressure being greater than the first pressure; and an outlet port in fluid communication with the valve chamber;

a valve member positioned within the valve chamber and configured to fluidly couple the valve chamber to the first conduit in a first position, and to fluidly couple the valve chamber to the second conduit in a second position; and an actuator coupled to the fuel injector body and configured to move the valve member such that the valve member is in each of the first position and the second position during distinct portions of a single fuel injection event, the fuel injector being configured to operate in at least three modes, wherein in a first mode, the valve member is positioned toward the second conduit during a first portion of the fuel injection event and fuel from the first fuel source is in fluid communication with the outlet port, in a second mode, the valve member is positioned toward the first conduit during a second portion of the fuel injection event and fuel from the second fuel source is in fluid communication with the outlet port, and in a third mode, the actuator modulates the valve member between the first and second positions such that at least a portion of the fuel from the first fuel source and at least a portion of the fuel from the second fuel source mix together in the valve chamber, and a pressure at the outlet port is less than the second pressure and greater than the first pressure, and the fuel injector body further comprises an upper housing for supporting a first portion of the actuator and a lower housing for supporting a second portion of the actuator, a shim is positioned between the upper and lower housings, and the arrangement of the shim is configured to regulate movement of the actuator during the fuel injection cycle.

* * * * *